United States Patent [19]

Redeker et al.

[11] 4,417,422

[45] Nov. 29, 1983

[54] GRINDING MACHINE

[75] Inventors: Werner Redeker, Escheburg; Uwe Uhlig, Hamburg, both of Fed. Rep. of Germany

[73] Assignee: Hauni-Werke Körber & Co. KG., Hamburg, Fed. Rep. of Germany

[21] Appl. No.: 232,250

[22] Filed: Feb. 6, 1981

[30] Foreign Application Priority Data

Feb. 15, 1980 [DE] Fed. Rep. of Germany ..... 3005606

[51] Int. Cl.[3] ..... B24B 19/14; B24B 41/06

[52] U.S. Cl. ..... 51/50 R; 51/5 D; 51/216 T; 51/80 R

[58] Field of Search ..... 51/5 D, 206 R, 50 R, 51/237 R, 95 LH, 80 R, 81 R, 327, 95 WH, 80 A, 89, 216 T, 216 ND, 103 R, 105 R, 105 LG; 125/11 CP; 269/71, 73

[56] References Cited

U.S. PATENT DOCUMENTS

| | | | |
|---|---|---|---|
| 1,491,079 | 4/1924 | Champion | 51/206 R |
| 2,127,210 | 8/1938 | Dunbar | 51/94 WH |
| 2,380,451 | 7/1945 | Koebel | 125/39 |
| 3,526,058 | 9/1970 | Price | 51/5 D |
| 3,977,126 | 8/1976 | Hohler et al. | 51/5 D |

FOREIGN PATENT DOCUMENTS

| | | | |
|---|---|---|---|
| 2122763 | 11/1972 | Fed. Rep. of Germany . | |
| 47-17292 | 2/1977 | Japan | 51/5 D |

OTHER PUBLICATIONS

High Performance Grinding Machines-Range 310 . . .

615, Blohm Schleifmaschinen, Robert Blohm GmbH Kampchaussee, 59, 2050 Hamburg 80.

*Primary Examiner*—Frederick R. Schmidt
*Assistant Examiner*—Robert A. Rose
*Attorney, Agent, or Firm*—Kontler, Grimes & Battersby

[57] ABSTRACT

A grinding machine with two parallel horizontal spindles which are movable radially of toward and away from each other and wherein each spindle carries a set of several coaxial grinding wheels having different outer diameters. The smaller wheels are nearer to and the larger wheels are more distant from the outer end portions of the respective spindles which are mounted, in cantilever fashion, in vertically movable carriers guided by vertical ways at the front side of an upright column forming part of the machine frame. The dressing mechanism for the grinding wheels has discrete coaxial or angularly staggered dressing discs for the respective grinding wheels, a common dressing disc for the grinding wheels on each spindle, or a single dressing disc for all of the grinding wheels. One or more workpieces are mounted on a holder which is rotatable relative to a support which, in turn, is rotatable relative to a table which is movable in parallelism with the axes of the spindles as well as tangentially of the grinding wheels so that each workpiece can be moved into engagement with a selected grinding wheel. The dressing disc or discs has or have different profiles, one for each grinding wheel, and the profile of each dressing disc is complementary to the profile of the peripheral working surface on the associated grinding wheel.

43 Claims, 9 Drawing Figures

GRINDING MACHINE

BACKGROUND OF THE INVENTION

The present invention relates to surface or form grinding machines, especially to improvements in machines for grinding of complex metallic workpieces. Typical examples of workpieces which can be treated in machines of the present invention are turbine blades. More particularly, the invention relates to improvements in grinding machines of the type wherein one or more grinding spindles serve to rotate grinding wheels and, in the case of a machine with two spindles, the spindles are parallel to each other and are movable radially toward and away from each other. Still more particularly, the invention relates to improvements in grinding machines of the type wherein the workpiece is mounted in a holder which is movable axially as well as tangentially of each grinding wheel. As a rule, such grinding machines are further provided with means for dressing or restoring the working surface or surfaces of the grinding wheel or wheels.

Precision form grinding of complex workpieces which have a plurality of uneven surfaces in presently known grinding machines is a complicated and costly procedure which involves the use of sophisticated control equipment and resort to specially designed modern grinding machines. Surface grinding of blanks of turbine blades is a typcial example of a complex grinding operation because such blanks exhibit a large number of uneven (concave, convex, twisted and analogous hard-to-treat) external surfaces. Therefore, the treatment of a complete turbine blade often involves an extraordinarily large number of successive grinding operations each of which includes the removal of material from a relatively small portion of the workpiece. In accordance with presently known techniques, turbine blades and workpieces of equally complex design are treated in a production line which employs a series of discrete grinding machines each of which is designed to remove material from a specific portion of the workpiece. The workpiece is transported from grinding machine to grinding machine, and each such machine has a specially designed grinding tool for the treatment of the corresponding specific portion of the workpiece. It is possible to provide such production lines with automatic or semiautomatic conveyor systems which transport the workpieces between successive grinding machines; however, this involves additional expenditures and contributes to the space requirements of the production line as well as to complexity, sensitivity and cost of automatic controls for the production line. Furthermore, the dimensions of the ultimate products are likely to deviate from the desired optimum dimensions for a variety of reasons such as the need to repeatedly release and clamp a workpiece preparatory and subsequent to transfer into the next-following grinding machine of the production line, the likelihood of inaccurate positioning of a workpiece in a given grinding machine with attendant removal of insufficient or excessive quantities of material from the corresponding portions of the workpiece, accidental damage to finished portions of a workpiece and/or unequal wear upon the component parts of discrete grinding machines and/or upon the means for transporting workpieces between such machine. In addition, the operation is time-consuming because each releasing, transporting and clamping step adds to the interval which is needed to complete the treatment of a workpiece. Additional time is lost because the output of the production line is dependent upon the operation of the slowest link, e.g., upon the operation of that grinding machine which requires the longest interval of time to complete the treatment of the corresponding specific portion of a workpiece. Still another drawback of such production lines is that each conversion for treatment of differently dimensioned and/or configurated workpieces is very time consuming so that the production lines are not sufficiently economical for the treatment of short or medium-long series of identical workpieces. A further drawback of a production line with an entire battery of serially arranged grinding machines is that all or nearly all of its machines are utilized well below capacity (due to the aforementioned fact that the interval of dwell of workpieces in each of several machines is determined by the interval of dwell in the slowest machine, i.e., in that machine which requires a relatively long period of time to complete the treatment of the corresponding portion of the workpiece). Last but not least, the entire production line must be arrested in response to malfunctioning of a single component, e.g., in response to temporary idling of a single machine of a full battery of discrete grinding machines. Therefore, such production lines are rather uneconomical except under certain exceptional circumstances, e.g., the need to grind a long series of identical complex workpieces. Even if the lack of economy is acceptable to certain manufacturers, the likelihood of deviation of dimensions of the ultimate product from optimum dimensions (primarily due to the need for repeated clamping and releasing of one and the same workpiece and the resulting danger of inaccurate positioning with reference to the grinding wheel in a machine) has deterred many potential purchasers from investing into such production lines.

It is already known to provide a grinding machine with two parallel spindles each of which carries a grinding wheel so that a workpiece can be treated, at the same time, by two discrete material removing tools. A machine which embodies pairs of spindles for discrete grinding wheels is known as Blohm 310/DK and is manufactured by the assignee of the present application. Such conventional machine is used for grinding of turbine blades and similar complex workpieces. However, even though two portions of one and the same workpiece can be treated in a simultaneous operation, complete grinding of an entire turbine blade still necessitates resort to several grinding machines and to appurtenant auxiliary equipment including conveyors and like apparatus. For example, the treatment of five differently configurated portions of a turbine blade necessitates the utilization of at least three discrete grinding machines with pairs of spindle for grinding wheels.

German Offenlegungsschrift No. 21 22 763 discloses a grinding machine which is specifically designed for the treatment of turbine blades. The treatment resembles that of workpieces in copying lathes, i.e., the configuration of a pattern is tracked and the position of the grinding wheel is changed accordingly. It has been found that the machine of the just mentioned German printed publication is not capable of treating complex portions of turbine blades or like workpieces with a desired degree of precision. At the very best, the machine is useful for grinding of those portions of workpieces which exhibit relatively large and simple surfaces. Typical examples of such relatively simple portions are the leaves of turbine blades; however, the more complex portions of such workpieces (e.g., those known as fir tree roots) must be treated in different types of grinding machines in accordance with the aforedescribed conventional technique involving the use of a discrete grinding machine for the grinding of each specific portion of the corresponding part of a turbine blade, namely, each portion whose surface is concave, convex, twisted or constitutes a combination of such surfaces.

OBJECTS AND SUMMARY OF THE INVENTION

An object of the invention is to provide a grinding machine, especially a numerically controllable grinding machine, which can treat complex workpieces in a time-saving operation and can perform the functions of several heretofore known grinding machines.

Another object of the invention is to provide a novel and improved grinding machine which comprises more than a single grinding wheel.

A further object of the invention is to provide a grinding machine which can be used as a superior substitute for an entire battery of conventional grinding machines.

An additional object of the invention is to provide a grinding machine which can be used with advantage for the treatment of workpieces which constitute or whose complexity approaches or exceeds that of turbine blades.

Still another object of the invention is to provide the grinding machine with novel and improved dressing means for restoring the working surfaces of grinding wheels, with novel and improved means for moving the grinding wheels to different positions, and with novel and improved means for positioning one or more workpieces with reference to the grinding wheels.

A further object of the invention is to provide a grinding machine which can be rapidly converted for the treatment of a wide variety of workpieces, whose space requirements are a minute fraction of space requirements of conventional equipment for performance of similar work, and which is constructed and assembled in such a way that all of its sensitive, critical or important parts are readily accessible.

An additional object of the invention is to provide the grinding machine with novel and improved means for dressing the working surface of any one of its plural grinding wheels.

Another object of the invention is to provide novel and improved means for moving and positioning the means for dressing the working surfaces of grinding wheels in a grinding machine of the above outlined character.

An additional object of the invention is to provide a grinding machine which can treat complex workpieces with a much higher degree of precision than heretofore known grinding machines or groups of grinding machines.

Still another object of the invention is to provide a grinding machine which can treat short, longer or very long series of workpieces with the same degree of precision, which can be used with advantage and substantial savings in time, energy and space for the treatment of relatively small or relatively large numbers of identical workpieces, which can be used without resorting to complex and bulky auxiliary equipment, and which requires a minimum of attention on the part of workmen.

An ancillary object of the invention is to provide novel and improved grinding tools for use in a machine of the above outlined character.

A further object of the invention is to provide a grinding machine which can complete the treatment of highly complex workpieces within surprisingly short intervals of time and with a heretofore unmatched degree of accuracy, and whose space requirements are a minute fraction of the space requirements of conventional equipment which is used to perform similar work.

Another object of the invention is to provide a grinding machine wherein a complex workpiece which requires several different treatments need not be removed and reinserted except after completion of the last treatment.

A further object of the invention is to provide a grinding machine which allows for the concentration of a plurality of different grinding operations in a small area.

A feature of the invention resides in the provision of a grinding machine, particularly a numerically controlled machine for surface grinding of complex workpieces (examples of such workpieces are turbine blades). The machine comprises at least one grinding tool including a rotary grinding spindle having an outer end portion and a plurality of coaxial grinding wheels mounted on and receiving torque from the spindle. The grinding wheels include a smaller-diameter wheel which is nearer to the outer end portion and a larger-diameter grinding wheel which is more distant from the outer end portion of the spindle. The machine further comprises means for rotating the spindle (such means may constitute a variable-speed prime mover which renders it possible to rotate the spindle at a number of different speeds so that the peripheral speed of any one of the grinding wheels which happens to be in actual use matches a predetermined peripheral speed). Still further, the machine comprises means for dressing the grinding wheels. The dressing means may comprise a discrete dressing device for each grinding wheel, a single dressing device for all grinding wheels or a dressing device with several profiles, one for each grinding wheel and each complementary to the profile of the working surface on the respective grinding wheel.

Still further, the grinding machine comprises a work holding means including a support, means for moving the support in parallelism with the axis of the spindle and/or tangentially of the grinding wheels, a work holder movably mounted on the support, means for rotating the work holder relative to the support about at least one axis, and at least one work gripping or clamping device (e.g., a collet) on the work holder.

In accordance with a presently preferred embodiment, the grinding machine comprises two grinding tools having parallel spindles each of which carries (or at least one of which carries) a plurality of coaxial grinding wheels. Each larger-diameter grinding wheel is more distant from the outer end portion of the respective spindle than the smaller-diameter grinding wheel or wheels. This renders it possible to gain access to the various grinding wheels and facilitates the dressing of working surfaces on such grinding wheels. The machine further comprises means for moving at least one of the grinding tools radially of the other grinding tool.

The novel features which are considered as characteristic of the invention are set forth in particular in the appended claims. The improved grinding machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
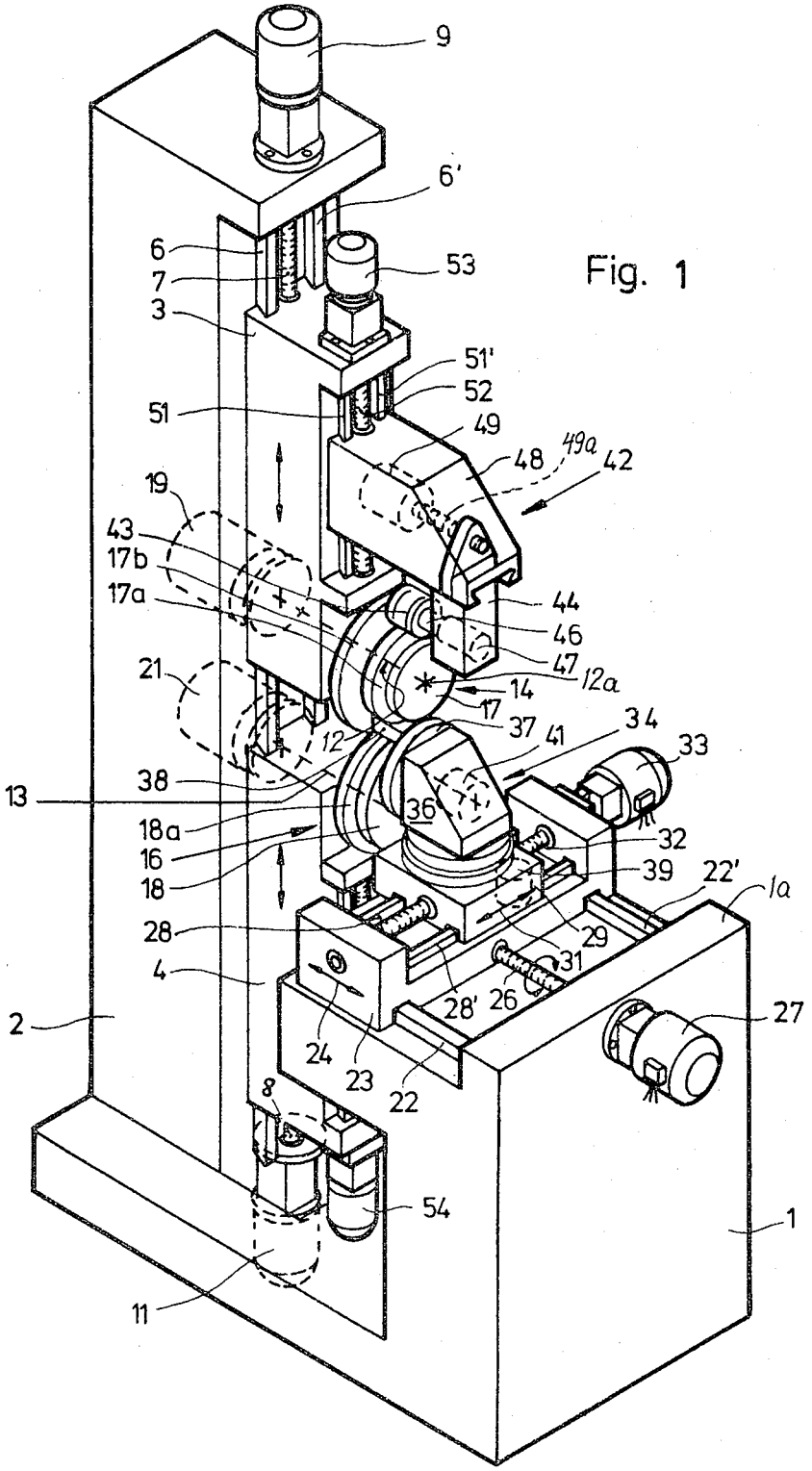
FIG. 1 is a somewhat schematic perspective view of a grinding machine with two spindles which embodies one form of the invention.

Referring first to FIG. 1, there is shown a surface grinding machine comprising a base or bed 1 which is mounted on the floor and the upper surface 1*a* of which is preferably disposed at the level of the top of a desk or table. The rear portion of the base 1 carries an elongated upright column 2 which, together with the base, constitutes the frame of the grinding machine. The relative dimensions of component parts of the grinding machine of FIG. 1 have been selected arbitrarily for the sake of clarity, i.e., the height of the column 2 can exceed the illustrated height (as compared with the height of the front portion of the base 1), and the dimensions of the parts which are carried by the base 1 and/or column 2 may but need not be proper as compared with the dimensions of the frame.

The column 2 supports two vertically movable carriers 3 and 4 which respectively support a first grinding tool 14 and a second grinding tool 16. The carrier 3 is disposed at a level above the carrier 4 and each of these carriers is reciprocable along vertical ways or rails 6 and 6' mounted at the front side of the column 2. The upper carrier 3 is reciprocable relative to the column 2 (i.e., toward and away from the lower carrier 4) by a reversible prime mover 9 (e.g., a variable-speed electric motor) which is mounted on the topmost portion of the column 2 and rotates a vertical feed screw 7 meshing with a nut in or on the carrier 3. Analogously, the lower carrier 4 is movable along the rails 6, 6' toward or away from the upper carrier 3 by a second reversible prime mover 11 (e.g., a variable-speed electric motor) which is mounted in or on the lower (rear) portion of the base 1 and rotates a vertical feed screw 8 meshing with a nut or an internally threaded portion of the carrier 4.

The upper grinding tool 14 comprises a horizontal grinding spindle 12 which is mounted in the carrier 3 in cantilever fashion so that its outer end portion (indicated at 12*a*) is remote from the carrier 3 and column 2, and a set of three coaxial grinding wheels 17, 17*a*, 17*b* which are secured to and can be rotated by the spindle 12. The smallest-diameter grinding wheel 17 is nearest to the outer end portion 12*a*, the largest-diameter grinding wheel 17*b* is remotest from the outer end portion 12*a*, and the median grinding wheel 17*a* has a diameter which is greater than that of the wheel 17 but smaller than that of the wheel 17*b*.

The second or lower grinding tool 16 comprises a horizontal grinding spindle 13 which is parallel to the spindle 12 and whose outer end portion is remote from the respective carrier 4 and column 2. When the carrier 3 and/or 4 moves along the rails 6, 6', the spindles 12 and 13 remain parallel to each other and the spindle 12 and/or 13 moves toward or away from the spindle 13 and/or 12.

The tool 16 further comprises two coaxial grinding wheels 18, 18*a* which can be driven by the spindle 13. The smaller-diameter grinding wheel 18 is nearer to the outer end portion of the spindle 13, and the larger-diameter grinding wheel 18*a* is more distant from the outer end portion of the spindle 13.

The spindle 12 can be driven by a variable-speed prime mover 19 (e.g., an electric motor) which is mounted at the rear or inner side of the carrier 3, and the spindle 13 can be driven by a similar prime mover 21 which is mounted on the lower carrier 4. The motor 19 can be started or arrested independently of the motor 21 and vice versa. The same preferably holds true for the aforementioned prime movers 9, 11, not only as regards the possibility to start or arrest the prime mover 9 independently of the prime mover 11 (or vice versa) but also as regards the possibility of operating any one of the prime movers 9, 11, 19, 21 independently of each other prime mover (this also includes changing the speed of those prime movers which can transmit torque at different speeds). Still further, the same preferably holds true for each and every other prime mover which is used in the grinding machine. This renders it possible to provide highly reliable and highly versatile numerical controls for the improved machine.

The feature that the diameters of the grinding wheels on the spindles 12 and 13 increase from wheel to wheel, as considered in the direction from the outer end portion toward the inner end portion of the respective spindle, ensures that each of the grinding wheels is readily accessible from the front side of the machine, i.e., to an attendant who is standing in front of the outer end portion 12*a* of the upper grinding spindle 12.

The upper side of the raised front portion of the base 1 has two spaced apart horizontal ways or rails 22, 22' which are parallel to the spindles 12, 13 and reciprocably guide a carriage 23. The means for moving the carriage 23 forwardly or backwards (arrow 24) along the rails 22, 22' comprises a reversible prime mover 27

(e.g., an electric motor) mounted at the front side of the base 1 and driving a feed screw 26 which meshes with the median portion of the carriage 23.

The carriage 23 has spaced apart horizontal ways or rails 28, 28' for a reciprocable table 29 serving to support and move a work holding means 34. The rails 28, 28' extend at right angles to the axes of the spindles 12, 13 and enable the table 29 to move in directions which are indicated by a double-headed arrow 31. The means for moving the table 29 relative to the carriage 23 comprises a reversible prime mover 33 (e.g., a variable-speed electric motor) which rotates a feed screw 32 extending in parallelism with the rails 28, 28' and meshing with the table 29.

The work holding means 34 comprises a support 36 which is rotatable relative to the table 29 about a vertical axis normal to the axes of the spindles 12 and 13. The means for rotating the support 36 about such vertical axis comprises a reversible prime mover 39 (e.g., a variable-speed electric motor) which is mounted in or on the table 29. The support 36 carries a work holder 37 which is rotatable about a horizontal axis by a reversible prime mover 41 (e.g., an electric motor) installed in or on the support 36. The work holder 37 carries at least one gripping or clamping device (e.g., a collet) for a workpiece 38. The prime movers 27, 33, 39 and 41 enable an attendant or an automatic unit to move the workpiece 38 to any one of a practically infinite number of different positions relative to the grinding tools 14 and 16. The prime mover 27 can move the entire work holding means 34 in parallelism with the axes of the spindles 12, 13, the prime mover 33 can move the workpiece 38 substantially tangentially of the grinding wheels **17–17*b* and 18–18*a*, the prime mover 29 enables the work holding means 34 to change its angular position (orientation) relative to the spindles 12, 13, and the prime mover 41 enables the workpiece 38 to turn about an axis which may be parallel to the axes of the spindles 12, 13 but whose orientation can be changed in a horizontal plane. Such versatility of the work holding means 34 renders it possible to perform a host of very simple and/or highly complex material removing operations on the workpiece 38 or on any other workpiece which can be properly mounted on the work holding means 34**.

Figure 2:
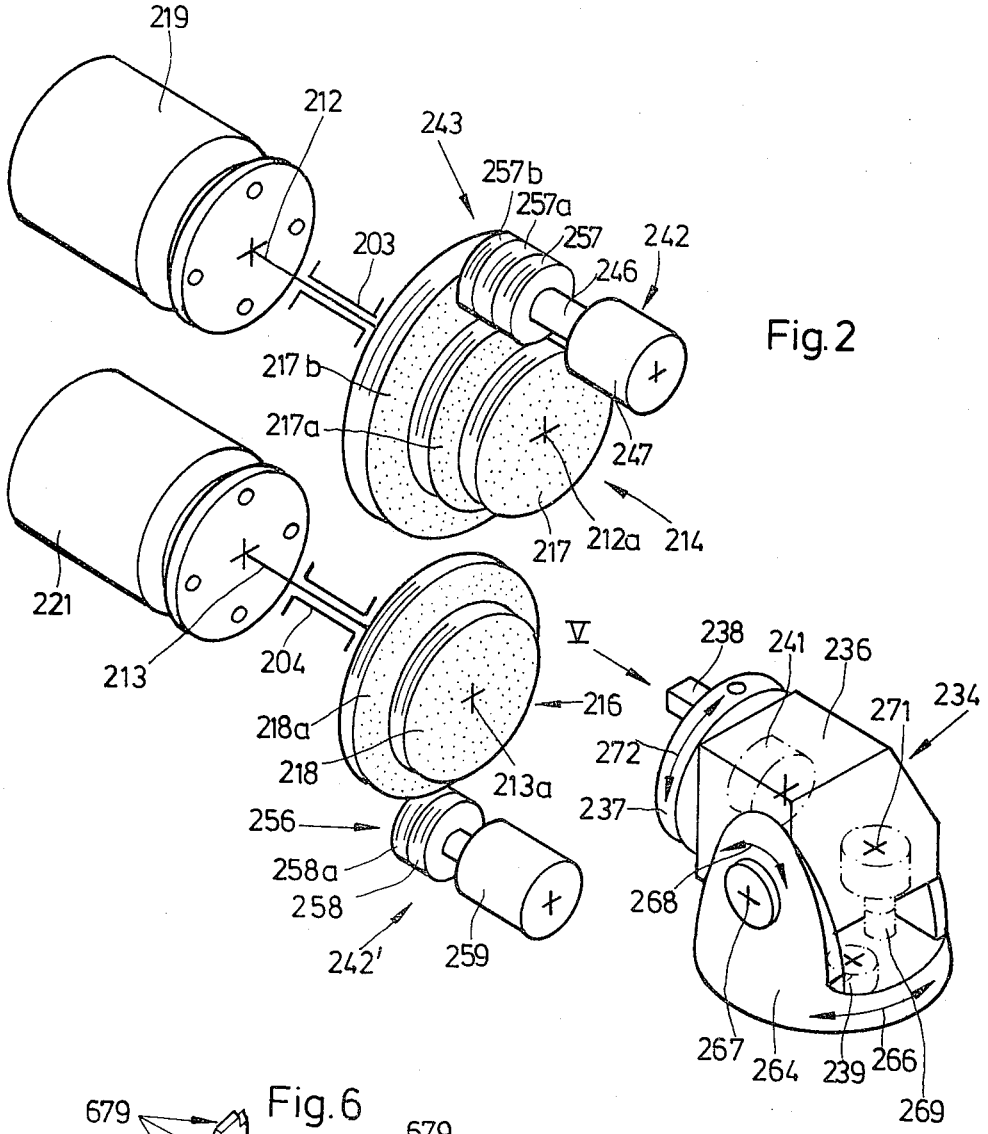
FIG. 2 is a greatly enlarged schematic perspective view of the two grinding tools, of the corresponding dressing means and of the work holding means in a slightly modified grinding machine.

The machine of FIG. 1 further comprises means for dressing the grinding wheels **17–17*b* and 18–18*a*. The dressing means in the machine of FIG. 1 comprises two sections or units, one for each of the grinding tools 14, 16, i.e., one for each or the two grinding spindles 12, 13. FIG. 1 merely shows the upper unit 42 which includes means for treating the working surfaces of the grinding wheels 17–17*b*. The unit 42 comprises a dressing device or tool 43 which is mounted on a shaft 46. The latter is parallel to the spindle 12 and is mounted, in cantilever fashion, in a supporting member 44. The supporting member 44 further supports a prime mover 47 (e.g., a variable-speed electric motor) for the shaft 46. The upper end portion of the supporting member 44 constitutes a horizontal tongue which is reciprocable in a complementary groove at the underside of a yoke-like supporting member 48. The groove of the supporting member 48 is parallel to the spindle 12. The means for moving the supporting member 44 relative to the supporting member 48 in parallelism with the spindle 12 comprises a prime mover 49 (e.g., a variable-speed electric motor) which rotates a feed screw 49*a* meshing with an upwardly extending lug of the supporting member 44. The front side of the upper carrier 3 has two parallel vertical ways or rails 51, 5,1' which extend at right angles to the spindle 12 and guide the supporting member 48. The latter is reciprocable radially of the spindle 12 by a prime mover 53 (e.g., a variable-speed electric motor) which is mounted on the carrier 3 and drives the supporting member 48 through the medium of a vertical feed screw 52. The exact details of the dressing device 43 cannot be seen in FIG. 1; this device can be constructed and configurated in a manner as shown in FIG. 2 (note the dressing device 243**).

The just described construction of the dressing section or unit 42 renders it possible to move the dressing device 43 to any one of a large number of different positions so that this device can properly restore the profile of the working surface of the grinding wheel **17, 17*a* or 17*b*. Thus, the dressing device 43 can be rotated about its own axis, it can be moved in parallelism with the axis of the spindle 12 for the grinding wheels 17–17*b*, and it can be moved radially of the spindle 12**.

The prime mover 54 (shown in the lower portion of FIG. 1) corresponds to the prime mover 53 and forms part of the other dressing unit or section having a dressing device for the grinding wheels **18, 18*a* on the lower spindle 13. The prime mover 54 is mounted at the underside of the lower carrier 4. The lower or second dressing unit or section (for the grinding wheels 18, 18*a*) may constitute a mirror image of the aforedescribed section or unit 42**.

The grinding machine of FIG. 1 with a total of five grinding wheels (**17, 17*a*, 17*b*, 18, 18*a*) constitutes a presently preferred embodiment of the invention. However, it is equally within the purview of the invention to increase the number of grinding wheels on the spindle 12 and/or 13, to omit the grinding tool 14 or 16, to reduce the number of grinding wheels on the spindle 12 to two or one, to reduce the number of grinding wheels on the spindle 13** to one or to resort to any combination of grinding wheels as long as the machine comprises at least one spindle which carries at least two grinding wheels having different diameters and the smaller-diameter grinding wheel is nearer to the outer end portion of the spindle. The number of grinding wheels will be selected in dependency on the nature of treatment and on the nature of the workpieces which are to be treated in the machine. Furthermore, the number of grinding wheels on a single spindle or on either of two or more spindles can be increased or reduced, again depending on complexity of the intended grinding operation and the nature of the workpieces.

FIG. 2 illustrates in greater detail a portion of a slightly modified grinding machine. All such parts of the structure shown in FIG. 2 which are identical with or clearly analogous to corresponding parts of the grinding machine of FIG. 1 are denoted by similar reference characters plus 200. Save for the work holding means, the structure shown in FIG. 2 is or can be an enlarged view of the corresponding parts of the grinding machine shown in FIG. 1. The carriers 203 and 204 are shown schematically, the same as the spindles 212 and 213. The reference characters **212*a* and 213*a* respectively denote the outer end portions of the corresponding spindles. The carriers 203 and 204 are movable up and down, i.e., toward or away from each other at right angles to the axes of the spindles 212, 213 which are parallel to each other. The upper grinding tool 214 comprises the spindle 212 and three grinding wheels 217, 217*a*, 217*b* which are coaxial with each other and receive torque from the spindle 212 when the corresponding prime mover 219 (preferably a variable-speed electric motor) is on. The smallest-diameter grinding wheel 217 is nearest to the outer end portion 212***a*, the largest-diameter grinding wheel 217*b* is remotest from the end portion 212*a*, and the diameter of the median grinding wheel 217*a* is larger than that of the grinding wheel 217 but smaller than that of the grinding wheel 217*b*. If the spindle 212 were to carry and drive four or more grinding wheels, the fourth grinding wheel would be located inwardly of the grinding wheel 217*b* and its diameter would exceed that of the grinding wheel 217*b*, etc.

The lower grinding tool 216 comprises the spindle 213 and two grinding wheels 218, 218*a* which receive torque from and are coaxial with the spindle 213. The smaller-diameter grinding wheel 218 is nearer to the outer end portion 213*a* than the larger-diameter grinding wheel 218*a*. As mentioned above, the placing of smaller-diameter grinding wheels nearer to the outer end portions of the respective spindles facilitates access to the grinding wheels and also simplifies the design and mode of operation of the associated dressing means.

The lower spindle 213 receives torque from the prime mover 221 (preferably a variable-speed electric motor).

The dressing means for the grinding tools 214, 216 comprises an upper dressing section or unit 242 and a lower dressing unit or section 242'. The upper unit 242 comprises a dressing device 243 serving to restore the working (peripheral) surfaces of the grinding wheels 217, 217*a* and 217*b*. The dressing device 256 of the lower unit 242' serves to treat the working surfaces of the grinding wheels 218 and 218*a*. In accordance with a feature of the invention, the dressing devices 243 has three coaxial portions or profiles 257, 257*a*, 257*b* which are respectively complementary to the profiles of working surfaces of the respective grinding wheels 217, 217*a*, 217*b*. The common shaft 246 for the profiles 257–257*b* of the dressing device 243 is driven by the prime mover 247. The axial distances between the grinding wheels 217, 217*a*, 217*b* suffice to allow for movement of the profiles 257, 257*a*, 257*b* into engagement with the corresponding working surfaces.

The lower dressing device 256 has two coaxial portions or profiles 258 and 258*a* which respectively serve to restore the working surfaces of the grinding wheels 218 and 218*a*. These profiles are mounted on and receive torque from a shaft which is driven by a prime mover 259. The manner in which the prime movers 247, 259 are mounted in the supporting members of the respective dressing units 242 and 242' is preferably the same as described in connection with FIG. 1; therefore, the remaining details of the units 242, 242' are not shown in FIG. 2. The profiles 257, 257*a*, 257*b* are respectively complementary to the profiles of working surfaces on the grinding wheels 217, 217*a*, 217*b*, and the profiles 258, 258*a* are respectively complementary to the profiles of working surfaces on the grinding wheels 218, 218*a*.

The grinding machine of FIG. 1 or the grinding machine which embodies the structure of FIG. 2 can perform at least five different grinding operations. In other words, the workpiece 38 or 238 (see the lower right-hand portion of FIG. 2) can be treated by five different grinding wheels each of which can have a specially designed working surface to ensure that it can treat a selected portion of the workpiece 38 or 238. This greatly reduces the outlay for treatment of relatively or highly complex workpieces since a single machine can perform the work of as many as five conventional grinding machines. The savings not only involve a reduction of the number of grinding machines which are needed to complete a particular type of treatment but also considerable saving in floor space in view of the fact that a single machine can do the work which heretofore was performed by several machines as well as by resort to conveyors for the transport of partially finished workpieces from machine to machine. By increasing the total number of grinding wheels, e.g., to six or seven, the versatility of the improved machine can be increased still further with a minimum of additional outlay.

A workpiece can be treated by one grinding wheel at a time or simultaneously by a grinding wheel on the upper spindle and a grinding wheel on the lower spindle. Regardless of whether the workpiece is treated by one or two grinding wheels at a time, its position relative to the work support need not be changed prior to treatment by a different grinding wheel or by a different pair of grinding wheels.

Figure 2A:
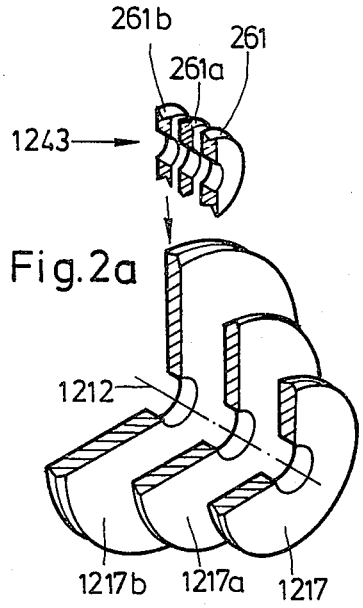
FIG. 2*a* is a fragmentary exploded perspective view of three coaxial grinding wheels and of the associated dressing device in a grinding machine which embodies the invention.

FIG. 2*a* illustrates portions of three coaxial grinding wheels 1217, 1217*a*, 1217*b* and parts of the corresponding portions or profiles 261, 261*a*, 261*b* of a dressing device 1243. The working surface of the smallest-diameter grinding wheel 1217 has two mirror symmetrical frustoconical portions with a ridge between such portions, and the corresponding profile 261 has a circumferential groove flanked by frustoconical surfaces which are complementary to the respective frustoconical surfaces on the working surface of the grinding wheel 1217. The working surface of the medium-diameter grinding wheel 1217*a* has a circumferential groove which is closely adjacent to one end face of the wheel 1217*a*, and the profile 261*a* is complementary to such working surface. The working surface of the largest-diameter grinding wheel 1217*b* is similar to that of the working surface on the smallest-diameter grinding wheel 1217; therefore, the profile 261*b* is similar to the profile 261. The profile of the working surface on the largest-diameter grinding wheel 1217*b* can be at least slightly or substantially different from the profile of the working surface on the grinding wheel 1217 and/or 1217*a*.

The work holding means 234 of FIG. 2 constitutes a modification of the work holding means 34 shown in FIG. 1. The work holding means 234 comprises a casing or frame member 264 which is rotatable about an axis normal to the axes of the spindles 212, 213, i.e., the axis of rotation of the frame 264 is vertical if the spindles 212, 213 are mounted in the same way as the spindles 12, 13 of FIG. 1. The directions in which the frame 264 can turn about a vertical axis are indicated by the double-headed arrow 266. The frame 264 is mounted on and is rotatable relative to a table (not shown in FIG. 2) corresponding to the table 29 of FIG. 1. The means for rotating the frame 264 relative to the table about the vertical axis includes a reversible prime mover 239. The support 236 of the work holding means 234 shown in FIG. 2 is mounted in the frame 264 so that it can rotate about the common axis of a pair of trunnions or stub shafts 267 only one of which can be seen in FIG. 2. The trunnions 267 are mounted in the upwardly extending flanges of the frame 264. The means for moving the support 236 about the common axis of the trunnions 267 comprises a reversible prime mover 271 which rotates an axially movable feed screw 269 abutting against the base plate of the frame 264 and located at one side of the common axis of the trunnions 267. The arrow 268 indicates the directions in which the support 236 can turn in response to starting of the prime mover 271. When the prime mover 271 is idle, the feed screw 269 prevents unintentional angular displacements of the support 236 relative to the frame 264, at least in one direction. The work holder 237 is mounted on the support 236 and is rotatable about a horizontal axis (see the double-headed arrow 272) by a reversible prime mover 241 mounted in the support 236 and serving to rotate a feed screw or the like. The workpiece 238 is removably installed in suitable gripping or clamping means of the work holder 237.

Figure 2B:
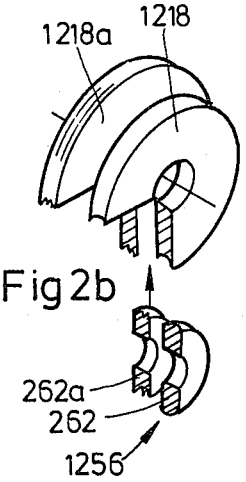
FIG. 2*b* is a similar fragmentary exploded perspective view of two coaxial grinding wheels and the associated dressing device.

FIG. 2b shows two coaxial grinding wheels including a smaller-diameter grinding wheel 1218 and a larger-diameter grinding wheel 1218a. The corresponding portions or profiles of the associated dressing device 1256 are respectively shown at 262 and 262a. The profile 262 is similar to the profile 261 or 261b of FIG. 2a, and the profile 262a has several circumferential grooves for complementary circumferential ridges or ribs of the working surface on the respective grinding wheel 1218a. It will be noted that the profile 262 is quite different from the profile 262a.

Figure 2C:
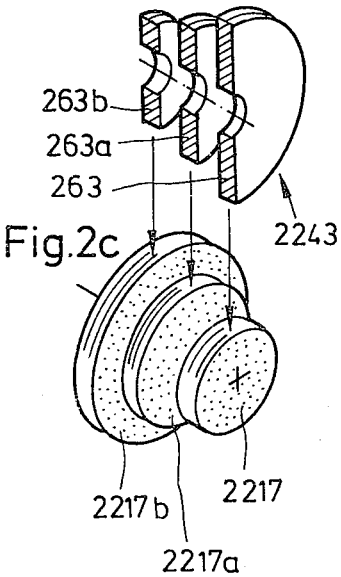
FIG. 2*c* is a perspective view of three coaxial grinding wheels and a fragmentary perspective view of a composite dressing device for the grinding wheels.

FIG. 2c shows three coaxial grinding wheels 2217, 2217a, 2217b and the corresponding profiles 263, 263a, 263b of a dressing device 2243. In contrast to the profiles of the dressing devices 1243 and 1256, the profiles 263, 263a, 263b of the dressing device 2243 of FIG. 2c are discrete discs which have different diameters selected in such a way that the working surfaces of the three grinding wheels 2217, 2217a and 2217b can be treated simultaneously. It goes without saying that the dressing device for a grinding tool with two wheels or with more than three wheels can be designed in the same way as the device 2243, i.e., for simultaneous dressing of only two or for simultaneous dressing of more than three grinding wheels by the discrete discs of a composite dressing device.

Figure 3:
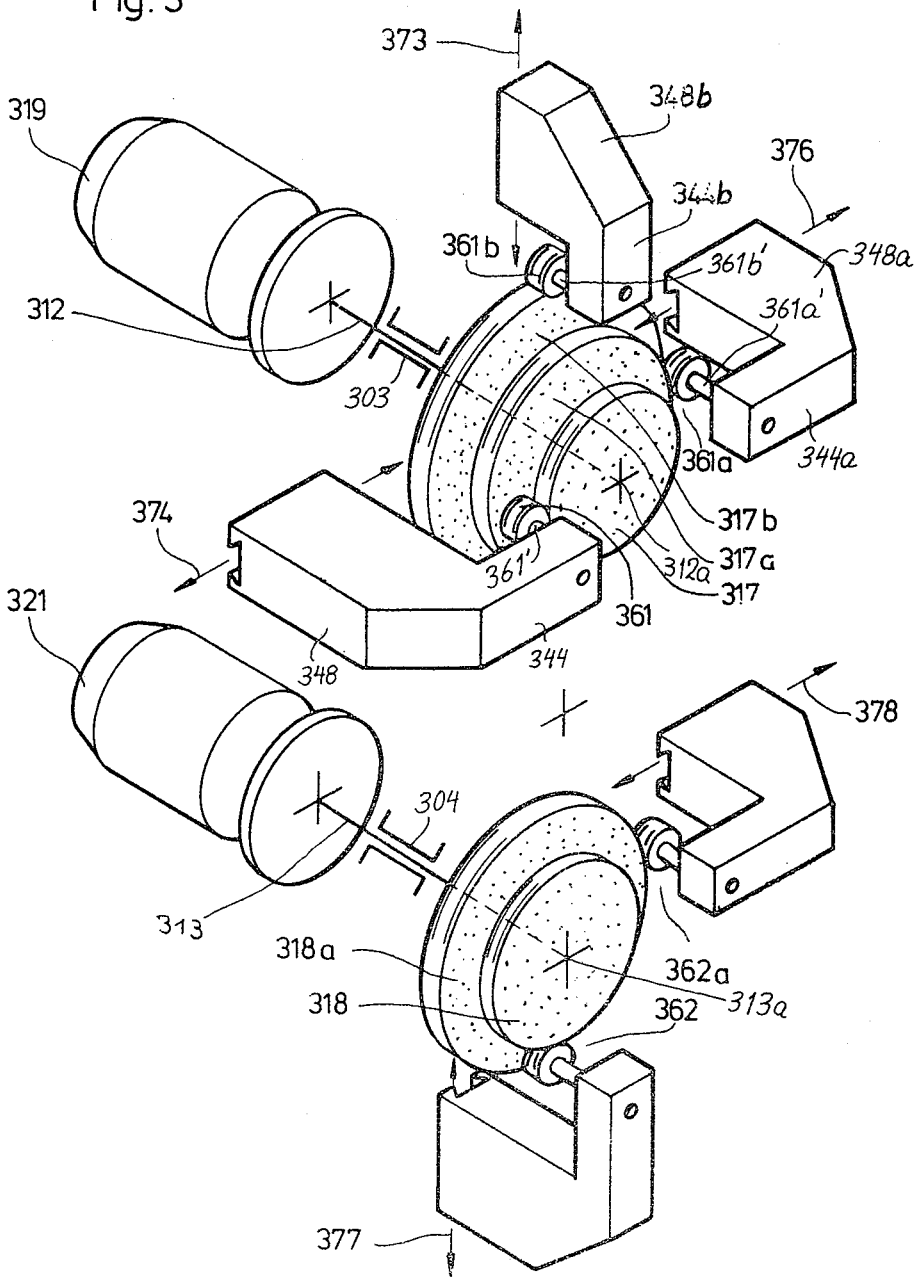
FIG. 3 is a fragmentary perspective view of a further grinding machine wherein the dressing means for the grinding wheels comprises a discrete dressing device for each of the wheels and wherein each dressing device is movable into and from engagement with the working surface of the respective grinding wheel independently of the other dressing devices.

FIG. 3 illustrates a portion of a further grinding machine wherein all such parts which are identical with or clearly analogous to corresponding parts of the machine shown in FIG. 1 or of the machine a portion of which is shown in FIG. 2 are denoted by similar reference characters plus 300 or 100, respectively. The upper horizontal grinding spindle 312 carries and transmits torque to three coaxial grinding wheels 317, 317a, 317b which are mounted in the same way as the grinding wheels 217, 217a, 217b of FIG. 2, i.e., the smallest-diameter grinding wheel 317 is nearest to the outer end portion 312a of the spindle 312, the medium-diameter grinding wheel 317a is inwardly adjacent to the wheel 317, and the maximum-diameter grinding wheel 317b is inwardly adjacent to the wheel 317a. The lower spindle 313 carries two coaxial grinding wheels 318, 318a with the larger diameter grinding wheel 318a inwardly adjacent to the smaller-diameter grinding wheel 318. The reference character 313a denotes the outer end portion of the spindle 313. The spindles 312, 313 are respectively driven by prime movers 319, 321 which are mounted in the corresponding carriers 303, 304 (schematically shown in FIG. 3 as bearings for median portions of the spindles 312, 313). The carriers 303, 304 are movable toward and away from each other in the same way as shown in FIG. 1 for the carriers 3 and 4.

In accordance with a feature of the embodiment which is illustrated in FIG. 3, the dressing means for the grinding wheels 317–317b and 318–318a comprises two composite sections or units each of which comprises several discrete portions, one of each of the grinding wheels. Thus, the upper unit has three portions, one for each of the grinding wheels 317–317b, and the lower unit has two portions, one for each of the grinding wheels 318, 318a. The three portions of the upper section or unit of the dressing means comprise discrete disc-shaped dressing devices 361, 361a, 361b for the three grinding wheels 317, 317a, 317b and discrete supporting members 344, 344a, 344b for the shafts 361', 361a', 361b' of the respective dressing devices. The supporting members 344, 344a, 344b are respectively movable relative to and with supporting members 348, 348a, 348b or are integral with the respective supporting members 348, 348a, 348b (this is shown in FIG. 3). The supporting members 348, 348a, 348b can move the corresponding supporting members 344, 344a, 344b and the respective dressing devices 361, 361a, 361b in the directions indicated by double-headed arrows 374, 376, 373, i.e., radially of toward or away from the associated grinding wheels 317, 317a and 317b.

Analogously, the lower unit comprises a portion with a disc-shaped dressing device 362 for the grinding wheel 318, and a portion with a disc-shaped dressing device 362a for the grinding wheel 318a. The directions in which the dressing devices 362 and 362a are movable, together with their supporting members, relative to the associated grinding wheels 318 and 318a are respectively indicated by double-headed arrows 377 and 378. It will be noted that the dressing devices 361–361b and 362–362a are angularly offset relative to each other, as considered in the circumferential direction of the respective spindles 312 and 313.

The structure of FIG. 3 allows for independent dressing of each of the five grinding wheels.

Figure 4:
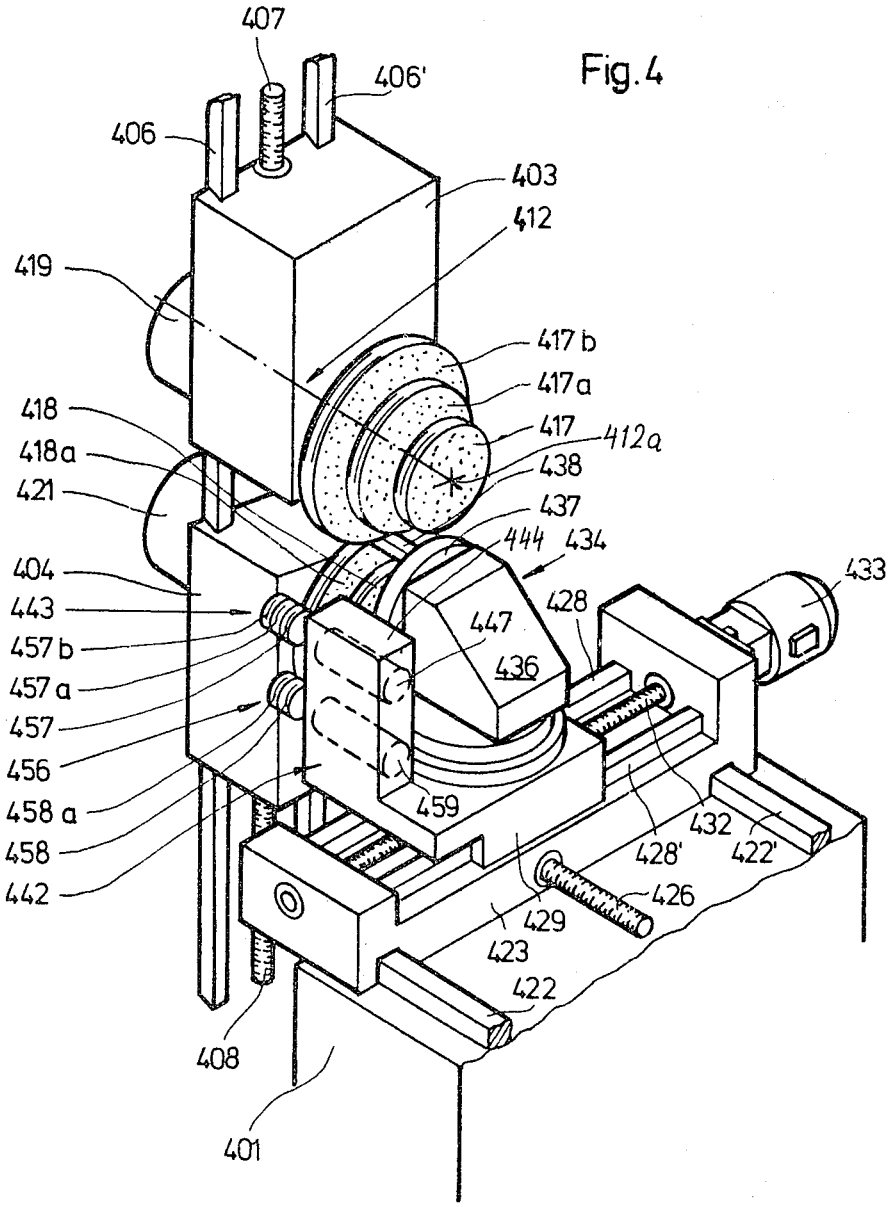
FIG. 4 is a fragmentary perspective view of still another grinding machine with simplified mounting of the dressing means for the grinding wheels.

FIG. 4 illustrates a portion of still another grinding machine wherein all such parts which are identical with or clearly analogous to the corresponding parts of the machine shown in FIG. 1 are denoted by similar reference characters plus 400. The upper horizontal spindle 412 (denoted by a phantom line) carries and rotates three coaxial grinding wheels 417, 417a and 417b with the largest-diameter grinding wheel 417b disposed at a maximum distance from and the smallest-diameter grinding wheel 417 located nearest to the outer end portion 412a. The spindle 412 is driven by a prime mover 419 which is mounted on the upper carrier 403. The latter is reciprocable along vertical guide rails 406, 406' and receives motion from a feed screw 407. The prime mover which can rotate the feed screw 407 in a clockwise or counterclockwise direction is not shown in FIG. 4.

The lower spindle (not shown) is parallel to the spindle 412 and is rotatable in the lower carrier 404 which is reciprocable along the rails 406, 406' by a vertical feed screw 408. The prime mover 421 for the lower spindle is mounted at the rear side of the carrier 404. The lower spindle carries and drives two coaxial grinding wheels including a smaller-diameter outer grinding wheel 418 and a larger-diameter inner grinding wheel 418a.

The bed or base 401 of the housing or frame of the grinding machine shown in FIG. 4 is provided with horizontal rails 422, 422' which are parallel to the spindles and guide a carriage 423 which is movable toward or away from the path of the carriers 403, 404 by a horizontal feed screw 426. The carriage 423 is fomed or connected with parallel horizontal rails or ways 428, 428′ for a table 429 which is movable by a feed scrw 432 receiving torque from a prime mover 433. The axis of the feed screw 432 is parallel to the rails 428, 428′ and normal to the two spindles.

The work holding means 434 includes a support 436 which is rotatably mounted on the table 429 so that it can turn back and forth about a vertical axis which is parallel to the axis of the feed screw 407 or 408. The work holder 437 is mounted on the support 436 and is rotatable about a horizontal axis. The reference character 438 denotes a workpiece which is releasably mounted on the holder 437 by one or more clamping or gripping devices of any known design. The heretofore described part of the grinding machine shown in FIG. 4 is identical or clearly analogous to the corresponding part or parts of the previously described grinding machine or machines.

In contrast to the previously described embodiments, the grinding machine which embodies the structure of FIG. 4 comprises a simplified dressing means 442 including an upper dressing device 443 with three profiles 457, 457*a*, 457*b* for the working surfaces of the respective grinding wheels 417, 417*a*, 417*b*, and a lower dressing device 456 with two profiles 458, 458*a* for the working surfaces of the corresponding lower grinding wheels 418, 418*a* The supporting member 444 of the dressing means 442 mounts the prime movers 447, 459 which respectively drive the dressing devices 443 and 456. This supporting member is separably or permanently attached to or made integral with the table 429. The axes about which the dressing devices 443 and 456 rotate are parallel to the axes of the two spindles.

The mounting of the supporting member 444 directly on the table 429 contributes to simplicity of the grinding machine which embodies the structure of FIG. 4. In spite of such simplification, each and every grinding wheel can be readily dressed independently of the other grinding wheels by the simple expedient of shifting the carriage 423 along the rails 422, 422′, the table 429 along the rails 428, 428′ and/or the carrier 403 and/or 404 along the rails 406, 406′. For example, the attendant can decide to treat the working surfaces of the five grinding wheels in the following sequence: 417*b*, 417*a*, 417, 418, 418*a*. The carrier 404 is caused to move the grinding wheels 418, 418*a* out of the way when the dressing device 443 is to treat the working surface of the grinding wheel 417, 417*a* or 417*b*, and the carrier 403 is moved upwardly to move the grinding wheels 417–417*a* out of the way when the dressing device 456 is to treat the working surface of the grinding wheel 418 or 418*a*.

The structure of FIG. 4 can be simplified still further by reducing the number of dressing devices and/or the number of profiles on the dressing devices. For example, a single dressing device with five different profiles or with a lesser number of profiles (including one) can be provided for the treatment of working surfaces on all five grinding wheels 417–417*b*, 418–418*a*, or each of the dressing devices 443, 456 can have a single profile. One of these profiles treats the working surfaces of the grinding wheels 417–417*b*, and the other profile treats the working surfaces of the grinding wheels 418–418*a*. It has been found that, if the working surfaces of the grinding wheels are not overly complex, a single dressing device with a single profile can be used for the dressing of all five working surfaces. This further reduces the initial and maintenance costs of the grinding machine and contributes to simplicity of the dressing operation.

In each embodiment of the improved grinding machine, the dressing means may comprise a discrete disc for each grinding wheel.

Figure 5:
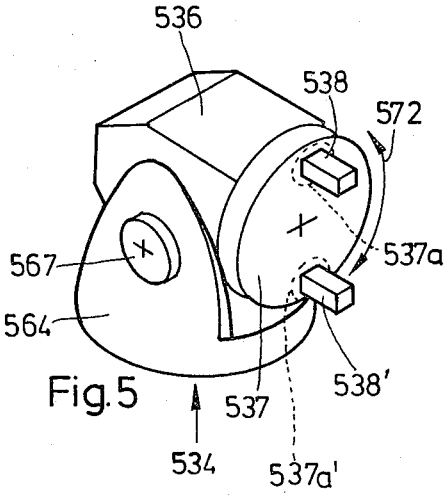
FIG. 5 is a perspective view of a modified work holding means for use in the grinding machine of the present invention.

FIG. 5 shows a further work holding means 534 as seen in the direction of arrow V in FIG. 2. The work holding means 534 is different from the work holding means 234 of FIG. 2 in that the work holder 537 (which is rotatable about a normally horizontal axis) is provided with two work gripping or clamping means 537*a*, 537*a*′ (indicated by broken-line circles) for two discrete workpieces 538 which are disposed diametrically opposite each other with reference to the axis of rotation of the work holder 537. The arrow 572 indicates the directions in which a prime mover (not shown) can turn the work holder 537 relative to the support 536 which is pivotable about a horizontal axis, namely, about the common axis of two trunnions or stub shafts 567 (only one shown in FIG. 5). The common axis of the trunnions 567 is normal to the axis of rotation of the work holder 537. The inclination of the axis of rotation of work holder 537 relative to the support 536 changes in response to angular displacement of the support 536 about the common axis of the trunnions 567. These trunnions are mounted in the upwardly extending flanges of a frame 564 which is rotatable about a vertical axis, the same as the frame 264 of FIG. 2, and is mounted on a table (not shown) corresponding to the table 29 of FIG. 1.

The gripping means 537*a*, 537*a*′ may define two sockets for the respective workpieces 538. A grinding machine which embodies the structure of FIG. 5 can be used with advantage for simultaneous treatment of at least certain sides or surfaces of plural workpieces in a simultaneous operation or for treatment of the two workpieces one after the other. Furthermore, the structure of FIG. 5 renders it possible to simultaneously clamp two spaced apart portions of a single workpiece, e.g., a highly complex workpiece or a workpiece which must be held against any and all movements relative to the work holder 537. Still further, the structure of FIG. 5 can simultaneously engage two discrete or interconnected parts of a composite workpiece.

Figure 6:
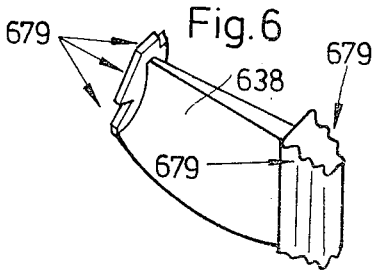
FIG. 6 is a perspective view of a complex workpiece which can be treated in the improved grinding machine.

FIG. 6 illustrates one (638) of a host of complex workpieces which can be treated in the grinding machine of the present invention. It can be readily seen that the workpiece 638 has many different profiles 679 with facets, grooves, channels, mutually inclined surfaces and/or other complex configurations which necessitate treatment in a specially designed rather than in a serially produced conventional grinding machine. If necessary, each of the various facets or profiles of the workpiece 638 can be treated by a different grinding wheel and/or in a separate step. In accordance with heretofore known techniques, a workpiece of the type shown in FIG. 6 must be treated in a series of discrete grinding machines each having a different grinding wheel or a differently mounted grinding wheel so as to facilitate the treatment of selected facets of the workpiece 638. As will be readily appreciated upon perusal of the preceding description, the improved grinding machine can treat a large number of or all facets on the workpiece 638 without it being necessary to transfer the workpiece from machine to machine. In fact, at least the majority of facets to be treated can be reached without changing the connection between the workpiece and the respective work holder. As a rule, the number of different operations which can be performed in the improved grinding machine will depend primarily or exclusively upon the number of grinding wheels. Thus, and since the improved grinding machine can readily embody a substantial number of grinding wheels, the treatment of a complex workpiece in such a machine can be completed within a small fraction of the time which is needed to complete such treatment by resorting to two or more conventional grinding machines. Therefore, the utilization of the improved machine brings about substantial savings as regards the initial cost, the maintenance cost, the need for spare parts, the total time which is necessary to complete a complex grinding operation, as well as the number of man hours since a single attendant can supervise the operation of at least one grinding machine which embodies the invention. Moreover, there is no need for costly, complex and space-occupying auxiliary equipment including conveyors for transport of workpieces from grinding machine to grinding machine.

The illustrated embodiments of the improved grinding machine employ a large number of discrete prime movers for imparting movements to the carriers for the spindles of the grinding tools, to the component parts of the work holding means and to the component parts of the dressing means. This is especially desirable and advantageous when the machine is equipped with numerical controls. However, it is equally within the purview of the invention to provide the machine with handwheels which replace some or all of the motors and can be actuated to impart to the corresponding components linear, angular or more complex movements. Furthermore, it is equally possible to employ fewer prime movers and to provide suitable operative connections between each prime mover and two or more movable components to thereby reduce the initial and maintenance cost of the grinding machine as well as the energy requirements of the prime mover system. It is further clear that the illustrated feed screws constitute but one form of means for transmitting motion from the prime movers to the corresponding movable parts. For example, at least some of these feed screws can be replaced with rack-and-pinion drives or with fluid-operated motors without departing from the spirit of the invention. The same holds true for the various guide rails; such guide rails can be replaced with grooves for tongues on movable parts or with stationary tongues extending into complementary grooves of the movable parts.

If the improved machine is equipped with prime movers, such prime movers are preferably electric motors. At least those motors which rotate the spindles of the grinding tools are preferably variable-speed electric motors which can drive the respective spindles at a plurality of speeds, for example, at a different speed for each grinding wheel on the respective spindle. This renders it possible to rotate all of the grinding wheels at a given peripheral speed in spite of the fact that the diameter of each grinding wheel in a set of two or more coaxial grinding wheels is different. Thus, and referring to FIG. 1, the motor 19 is preferably designed to drive the spindle 12 at a relatively low first speed when the workpiece 38 is treated by the largest-diameter grinding wheel 17*b*, at a higher speed when the workpiece is treated by the medium-diameter grinding wheel 17*a*, and at a maximum speed when the workpiece is treated by the smallest-diameter grinding wheel 17. The same preferably applies for the motor 21 and spindle 13 except that the spindle 13 need not be driven at more than two different speeds in order to ensure that the peripheral speed of the grinding wheel 18 or 18*a* will match a predetermined value when the workpiece 38 is respectively treated by the wheel 18 or 18*a*. Such mode of treatment is often desirable in order to avoid overheating of tools and/or workpieces and/or to reduce the likelihood of removal of excessive quantities of material from the workpieces.

A workpiece must be removed from the improved grinding machine prior to completion of the last of several treatments only if the number of different treatments exceeds the number of grinding wheels in the machine or if the machine cannot accept all of the grinding wheels which are needed to complete a particular treatment or series of treatments. It is also possible to leave one or more workpieces in the machine and to replace one or more grinding wheels if the number of required treatments exceeds the total number of grinding wheels which can be supported by the spindle or spindles of the improved machine.

The improved machine renders it possible to provide numerical controls for the operations which must be carried out on highly complex workpieces, namely, on workpieces which, heretofore, necessitated treatment in a number of discrete grinding machines. Numerical controls contribute to greater reproducibility of operation, i.e, they ensure that each of a long or short series of workpieces is or can be subjected to identical treatment or treatments.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a grinding machine, particularly in a numerically controllable machine for surface grinding of complex workpieces, such as turbine blades, the combination of at least one grinding tool including a rotary grinding spindle having an outer end portion and a plurality of coaxial grinding wheels on said spindle, said wheels including a smaller-diameter wheel nearer to and a larger-diameter wheel more distant from said outer end portion; means for rotating said spindle; means for dressing said wheels; a table; work holding means movably mounted on said table and including a support; a work holder movably mounted on said support; means for rotating said support relative to said table about an axis which is normal to the axis of said spindle; means for rotating said work holder relative to said support about an axis which is parallel, at least at times, to the axis of said spindle; and at least one work gripping device mounted on said work holder.

2. The combination of claim 1, wherein each of said grinding wheels has a predetermined profile and said dressing means includes at least one rotary dressing device for said wheels, said dressing device having profiles complementary to the profiles of said grinding wheels.

3. The combination of claim 1, further comprising means for moving said work holding means in parallelism with the axis of said spindle and tangentially of said grinding wheels.

4. The combination of claim 1, further comprising a second grinding tool including a second spindle parallel to said first mentioned spindle and having an outer end portion and a plurality of coaxial additional grinding wheels on said second spindle, said additional wheels including a smaller-diameter first wheel nearer to and a larger-diameter second wheel more distant from the outer end portion of said second spindle, and means for moving at least one of said grinding tools relative to and substantially radially of the other of said grinding tools.

5. The combination of claim 1, wherein said grinding tool includes a third grinding wheel which is remotest from the outer end portion of said spindle and whose diameter exceeds the diameter of said larger-diameter wheel.

6. The combination of claim 1, further comprising means for moving said tool at right angles to the axis of said spindle.

7. The combination of claim 6, wherein said means for moving said tool comprises a carrier, said spindle being mounted in said carrier in cantilever fashion so that said outer end portion thereof is remote from the carrier.

8. The combination of claim 1, wherein said spindle is substantially horizontal and said support is rotatable relative to said table about a substantially vertical axis.

9. The combination of claim 1, further comprising a carriage movably supporting said table, said table being movable relative to said carriage in a substantially horizontal plane and in directions at right angles to the axis of said spindle.

10. The combination of claim 1, wherein said work holding means further comprises a frame interposed between said table and said support and means for rotating said frame about an axis which is normal to the axis of said spindle.

11. The combination of claim 1, further comprising means for mounting said support in said frame for pivotal movement about an axis which is normal to the axis of rotation of said frame relative to said table.

12. The combination of claim 11, wherein said spindle is horizontal and the axis of pivotal movement of said support relative to said frame is horizontal, said frame being rotatable relative to said table about a vertical axis.

13. The combination of claim 1, further comprising a carriage movably supporting said table, said table being movable with respect to said carriage at right angles to the axis of said spindle, and further comprising discrete first and second prime mover means for moving said carriage relative to said spindle and for moving said table relative to said carriage, said means for rotating said work holder and said support including additional discrete prime mover means.

14. The combination of claim 13, further comprising a frame interposed between said support and said table and means for rotating said support relative to said frame, said rotating means comprising additional discrete prime mover means.

15. The combination of claim 1, wherein each of said grinding wheels has a peripheral working surface with a predetermined profile and the profiles of said working surfaces are different from grinding wheel to grinding wheel.

16. The combination of claim 15, wherein said dressing means comprises a rotary dressing device having a plurality of different peripheral profiles each complementary to the profile of a different grinding wheel.

17. The combination of claim 16, wherein the profiles of said dressing device are coaxial and adjacent to each other.

18. The combination of claim 1, wherein said dressing means comprises a dressing device for said grinding wheels, said dressing device comprising a plurality of discrete discs, one for each of said grinding wheels.

19. The combination of claim 18, wherein said discs are staggered with respect to each other, as considered in the circumferential direction of said spindle.

20. The combination of claim 18, wherein said discs are coaxial.

21. The combination of claim 20, wherein said discs have different diameters and said dressing means further comprises means for simultaneously moving said discs into engagement with the peripheral surfaces of the respective grinding wheels.

22. The combination of claim 21, wherein the diameter of the disc for said larger-diameter grinding wheel is less than the diameter of the disc for said smaller-diameter grinding wheel.

23. The combination of claim 1, further comprising a second grinding tool having a second spindle parallel to said first mentioned spindle and at least one additional grinding wheel on said second spindle, said dressing means including at least one dressing device for the grinding wheels on said first mentioned spindle, and a dressing device for said additional grinding wheel.

24. The combination of claim 1, wherein said dressing means comprises a common dressing device for all of said grinding wheels.

25. The combination of claim 24, further comprising a second grinding tool including a second spindle parallel to said first mentioned spindle and at least one additional grinding wheel on said second spindle.

26. The combination of claim 1, further comprising means for moving said holding means relative to said spindle and an additional work gripping device on said holder.

27. The combination of claim 26, wherein said gripping devices are mirror symmetrical to each other with reference to a plane including the axis of rotation of said work holder.

28. The combination of claim 1, further comprising means for moving said holding means so as to move the workpiece which is held by said gripping device into engagement with successive grinding wheels.

29. The combination of claim 1, wherein said means for rotating said spindle includes variable-speed prime mover means operative to rotate said spindle at a plurality of different speeds so as to drive any one of said grinding wheels at a predetermined peripheral speed when the respective wheel is in material-removing engagement with a workpiece.

30. The combination of claim 1, wherein said means for rotating said spindle includes a first electric motor and further comprising a plurality of discrete additional electric motors including an electric motor for moving said spindle in directions at right angles to the axis thereof, an electric motor for rotating a portion of said dressing means about an axis which is parallel to the axis of said spindle, at least one electric motor for moving said portion of said dressing means relative to said spindle, and at least one electric motor for moving at least one workpiece relative to said grinding wheels.

31. The combination of claim 1, further comprising means for moving said spindle up and down together with said rotating means.

32. In a grinding machine, particularly in a numerically controllable machine for surface grinding of complex workpieces, such as turbine blades, the combination of at least one grinding tool including a rotary grinding spindle and at least one grinding wheel on said spindle; means for rotating said spindle; means for moving said tool at right angles to the axis of said spindle, said moving means comprising a carrier and said spindle being mounted in said carrier in cantilever fashion; and means for dressing said grinding wheel, said dressing means comprising a first supporting member mounted on said carrier and movable substantially radially of said spindle, a second supporting member mounted on said first supporting member, a rotary shaft parallel to said spindle and mounted in said second supporting member in cantilever fashion, and at least one dressing device mounted on and rotatable with said shaft.

33. The combination of claim 32, wherein said spindle has an outer end portion which is remote from said carrier and said tool comprises a plurality of coaxial grinding wheels, said wheels including a smaller-diameter wheel nearer to and a larger-diameter wheel more distant from said outer end portion, said second supporting member being movable relative to said first supporting member in parallelism with the axis of said spindle.

34. The combination of claim 33, wherein said first supporting member is a yoke.

35. The combination of claim 33, wherein said means for moving said tool further comprises first prime mover means for moving said carrier at right angles to the axis of said spindle and said means for rotating said spindle comprises second prime mover means, and further comprising third prime mover means for moving said first supporting member relative to said carrier, fourth prime mover means for moving said second supporting member relative to said first supporting member, and fifth prime mover means for rotating said shaft.

36. The combination of claim 35, wherein each of said prime mover means is operable independently of the other prime mover means.

37. The combination of claim 32, further comprising work holding means including a table movable relative to said spindle, said dressing means being mounted on and being movable with said table.

38. In a grinding machine, particularly in a numerically controllable machine for surface grinding of complex workpieces, such as turbine blades, the combination of at least one grinding tool including a rotary grinding spindle having an outer end portion and a plurality of coaxial grinding wheels on said spindle, said wheels including a smaller-diameter wheel nearer to and a larger-diameter wheel more distant from said outer end portion; means for rotating said spindle; a table; work holding means movably mounted on said table and including a support; a work holder movably mounted on said support; means for rotating said support relative to said table about an axis which is normal to the axis of said spindle; at least one work gripping device mounted on said work holder; means for moving said tool at right angles to the axis of said spindle including a carrier, said spindle being mounted in said carrier in cantilever fashion; and means for dressing said wheels including a first supporting member mounted on said carrier and movable substantially radially of said spindle, a second supporting member mounted on and movable relative to said first supporting member in parallelism with the axis of said spindle, a rotary shaft parallel to said spindle and mounted in said second supporting member in cantilever fashion, and at least one dressing device mounted on and rotatable with said shaft.

39. The combination of claim 38, wherein said first supporting member is a yoke.

40. The combination of claim 38, wherein said means for moving said tool further comprises first prime mover means for moving said carrier at right angles to the axis of said spindle and said means for rotating said spindle comprises second prime mover means, and further comprising third prime mover means for moving said first supporting member relative to said carrier, fourth prime mover means for moving said second supporting member relative to said first supporting member, and fifth prime mover means for rotating said shaft.

41. The combination of claim 40, wherein each of said prime mover means is operable independently of the other prime mover means.

42. The combination of claim 1, further comprising a second grinding tool including a rotary second grinding spindle parallel to said first mentioned spindle and having an outer end portion, and a plurality of coaxial additional grinding wheels on said second spindle, said additional wheels including a smallest-diameter wheel nearest to the outer end portion of said second spindle, a largest-diameter wheel farthest from the outer end portion of said second spindle, and a third wheel between said smallest-diameter and largest-diameter wheels, said third wheel having a diameter which is larger than the diameter of said smallest-diameter wheel but smaller than the diameter of said largest-diameter wheel.

43. The combination of claim 42, wherein said spindles are substantially horizontal and said second spindle is located at a level above said first mentioned spindle.

* * * * *